United States Patent [19]

Solomon

[11] Patent Number: 4,480,676

[45] Date of Patent: Nov. 6, 1984

[54] INSULATION ASSEMBLY

[76] Inventor: Victor J. Solomon, 1638 Doris Dr., Sarasota, Fla. 33580

[21] Appl. No.: 532,495

[22] Filed: Sep. 15, 1983

[51] Int. Cl.[3] ..... E06B 9/17

[52] U.S. Cl. ..... 160/272; 160/290 R

[58] Field of Search ..... 160/267-273, 160/290, 23 R, 41

[56] References Cited

U.S. PATENT DOCUMENTS

| | | | |
|---|---|---|---|
| 1,141,918 | 6/1915 | Smith . | |
| 1,605,583 | 11/1926 | Heymer . | |
| 1,942,200 | 1/1934 | Brust . | |
| 2,221,005 | 11/1940 | Reese . | |
| 2,247,634 | 7/1941 | Houston | 160/41 |
| 2,270,978 | 1/1942 | Swormstedt . | |
| 2,325,992 | 8/1943 | Wirtham . | |
| 2,504,204 | 4/1950 | Kiefer . | |
| 2,509,398 | 2/1950 | Peremi . | |
| 2,548,041 | 4/1951 | Morse | 160/23 R |
| 2,756,438 | 7/1956 | Soberman . | |
| 2,908,326 | 10/1959 | Jewell | 160/273 R |
| 2,925,862 | 2/1960 | Sundby . | |
| 3,196,935 | 7/1965 | Christensen | 160/290 R |
| 3,214,879 | 11/1965 | Ellingson . | |
| 3,636,661 | 1/1972 | Strawsine . | |
| 4,068,428 | 1/1978 | Peterson . | |
| 4,258,517 | 3/1981 | Hammond | 160/290 R |

*Primary Examiner*—Peter M. Caun

*Attorney, Agent, or Firm*—Arthur W. Fisher, III

[57] ABSTRACT

An insulation assembly comprising a retractable flexible panel member mounted on a roller element affixed within a conventional portal frame structure including a closure such as a window or door, a pair of side track elements and a lower track element disposed to selectively engage the peripheral edges of the flexible panel member when in the extended position so as to substantially seal the space between the flexible panel member and the closure from the interior of the enclosure.

6 Claims, 5 Drawing Figures

INSULATION ASSEMBLY

BACKGROUND OF THE INVENTION

1. Field of the Invention

An insulation assembly including a retractable flexible panel member to substantially seal a window or door portal.

2. Description of the Prior Art

It is a well recognized problem that excessive energy loss results from leakage of outside air through existing or permanently installed window and door structures. It is estimated that as much as thirty percent of heat loss of enclosed room, building or area is a result of leakage from window fixtures into heated enclosed area. As a result, the construction industry has endeavored to design structures to be used in combination with existing windows and doors. Such attempts to save energy and heat loss have resulted in window construction such as storm type windows, double pane and even triple pane windows each separated by an insulating air space. However, by far the majority of such existing insulating assemblies include the use of a rigid plastic or glass panel permanently or semi-permanently affixed within the window sash or frame. Such structures are generally expensive to purchase and install.

A variety of such structures including shields of various types have been applied to windiws and doors to provide insulated air spaces. Generally such prior art structures are used to conserve heat and to prevent moisture in the air from condensing on the inner surface of the glass and closure whereby visability through the glass and transmission of light remains unimpaired.

The following U.S. Patents are representative of prior art structures which have attempted to overcome these problems set forth above: U.S. Pat. Nos. 1,942,202 to Brust; 2,221,005 to Reese; 2,504,204 to Kiefer; 2,925,862 to Sunby; 3,214,879 to Ellingson; and 3,636,661 to Strawsine.

In addition, double glazed window structures which may be permanently affixed in the building during initial installation are represented by U.S. Pat. No. 1,605,583 to Heymer. Relatively portably affixed insulating type panels having a glass or plastic base are represented in U.S. Pat. No. 4,068,428 to Peterson wherein the panels are particularly portable through its hook and loop type fastening arrangement which secures the outer panel to the outside of the window frame in spaced relation to the regular window pane.

While all of the aforementioned type of structures are applicable for certain specific uses and functional to at least a certain level of efficiency, such structures suffer from inherent problems. These include continued leakage which still has a harmful effect on the amount of heat loss in a heated enclosure. Also, the cost of initial purchase and installation of such structures and the general esthetic effect of such structures in existing dwellings, residences or business offices is often less than desirable.

Accordingly there is a need in the building industry for an insulation assembly which is capable of being procurred at a relatively low initial purchase cost as well as being installed either on a do-it-yourself basis or a substantially reduced price. Such structure should be as efficient as possible without adding to the cost of maintenance or allowing the structure of the device to be overly complicated or complex. Inherently such desired structure should include the ability to isolate a predetermined amount of space between the permanently affixed window pane and the insulating barrier or panel being utilized. Preferably, such base should be at least one and one-half inches so as to prevent the creation of any type of convection currents being activated within the air space. Accordingly it is highly desirable to create an effectively "dead" air space which acts as throughly efficient insulating barrier.

SUMMARY OF THE INVENTION

The subject invention relates to an insulation assembly specifically designed to be mounted on the interior of a window or door casement. A flexible panel member is disposed in spaced relation relative to the window or door which cooperatively form a void or space therebetween.

The flexible panel member comprises a flexible material attached to a single stop roller means disposed within a shield means. Rotation of the roller means allows extension and retraction of the flexible panel element. In the extended position, the flexible panel is disposed along the entire length of the window and thereby serves to effectively isolate the air space which exists between the plane defined by the permanently installed window or door and the flexible panel.

The air space existing between the plane of the window and the plane of the flexible panel means effectively forms a thermal pane structure. This air space effectively isolates the interior of the room or dwelling from the window or door and significantly reduces convection currents.

A pair of side track means effectively seal off the peripheral edge portions of the panel means while a lower track means seals off the lower peripheral edge portion of the panel means.

A panel gripping means includes means to selectively lock the panel means to the lower track means when the flexible panel member is fully extended.

A convex shield means is specifically configured to engage the upper portion of the flexible panel member to form a seal therebetween.

In operation downward extension of the flexible panel member causes the side or longitudinal peripheral edges thereof to travel on the interior of the side track means. When the panel reaches its full extension the lower most peripheral edge is disposed on the interior of the lower track means to effectively seal or isolate air space as previously disclosed.

The invention accordingly comprises the features of construction, combination of elements, and arrangement parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
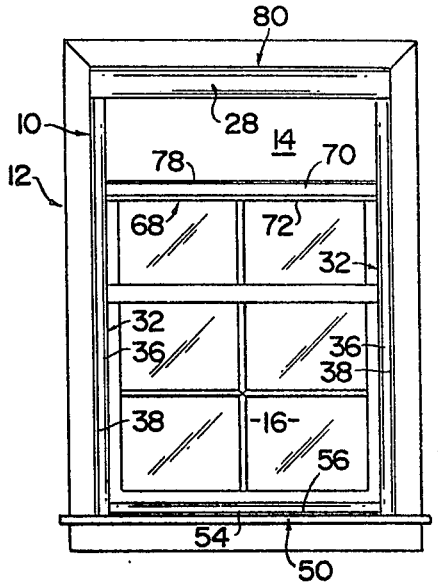
FIG. 1 is a front plane view of the structure of the present invention installed on the inside of a conventional window casement frame.
Figure 2:
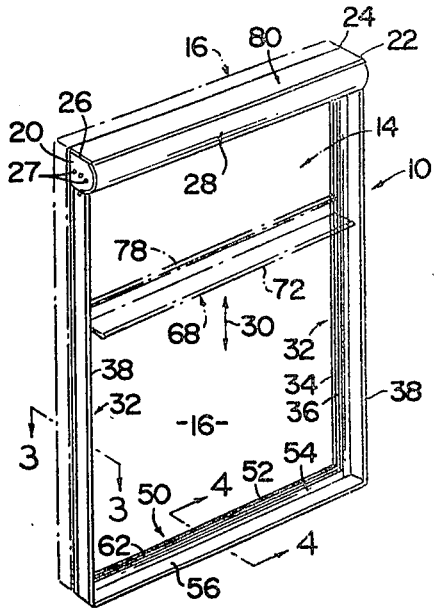
FIG. 2 is a prespective view of the embodiment of FIG. 1.

As shown in FIGS. 1 and 2 the subject invention comprises an insulation assembly generally indicated as 10 specifically designed to be mounted on the interior of a window or door casement 12. A flexible panel member 14 is disposed in spaced relation relative to the window or door 16 which cooperatively form a void or space therebetween.

The flexible panel member 14 comprises a flexible material capable of being rolled about itself in concentric relation relative to a single stop roller means 18 of conventional construction. The roller support means includes a pair of end plates 20 and 22. The interior edge 24 of each plate 20 and 22 engeges a portion of the inner frame substantially adjacent to the window 16. Accordingly, the upper edge portion 26 of each of the end plates 20 and 22 is secured to the upper inner surface of the frame 12. Each of the end plates 20 and 22 is specifically configured to rotatably support the end portions of the roller means 18. Apertures and/or connectors 27 are integrally formed into the respective end plates 20 and 22. The roller means 18 is disposed within a shield means 28. Rotation of the roller means 18 allows downward extension and upward retraction of the flexible panel element 14 as indicated by directional arrow 30. In its upward, retracted position the flexible panel 14 is disposed in surrounded supported relation about the roller means 18. In its downward, extended position the flexible panel 14 is disposed along the entire length of the window 16 and thereby serves to effectively isolate the air space which exists between the plane defined by the permanently installed window or door 16 and the flexible panel 14.

Figure 3:
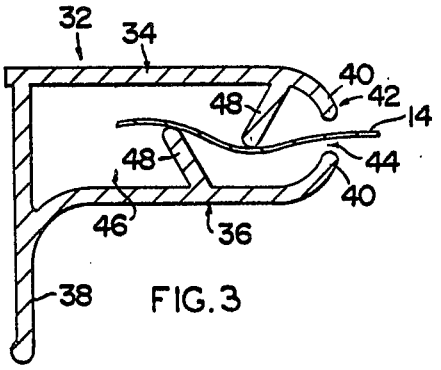
FIG. 3 is a cross-sectional detail top view of a side track element taken along line 3—3 of FIG. 2.

The air space existing between the plane of the window or door 16 and the plane of the flexible panel means 14 effectively forms a thermal pane structure. This air space effectively isolates the interior of the room or dwelling from the window or door. A pair of side track means 32 effectively seal off the peripheral edge portions of the panel means 14. As best shown in FIG. 3, each side track means 32 comprises a first and second side track member generally indicated as 34 and 36 respectively disposed in substantially parallel spaced relation relative to each other on a base member 38. The outer portions 40 of the first and second side track member 34 and 36 are curved inwardly relatively to each other to cooperatively form a convex shape 42 having slot 44 formed therebetween. A transverse edge of the panel member 14 is received within the cavity 46 defined by the first and second side track members 34 and 36. A pair of inwardly projecting sealing elements each indicated as 48 causes the flexible panel member 14 to make a curvilinear path within the cavity 46 to thereby enhance the sealing engagement of the transverse edge of the panel 14. The sealing elements 48 are diagonally inclined and extend past the longitudinal center line of the cavity 46.

Figure 4:
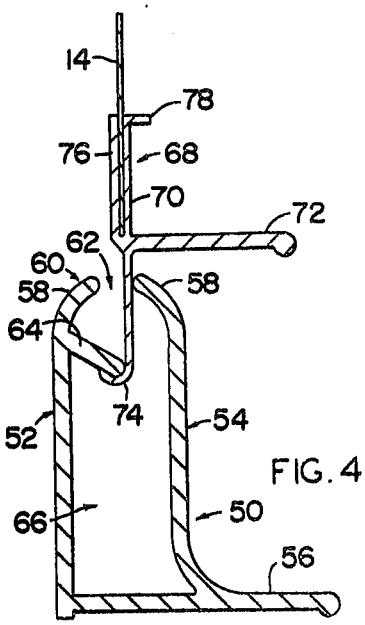
FIG. 4 is a cross-sectional detail side view of a lower track element taken along line 4—4 of FIG. 2 in combination with the panel securing means.

As best shown in FIG. 4, lower track means 50 extends across the lower portion of insulation assembly 10. The lower track means 50 is similar in structure to the side track means 32. Specifically the lower track means 50 comprise a first and second lower track member generally indicated as 52 and 54 respectively disposed in substantially parallel spaced relation relative to each other on a base 56. The outer portion 58 of the first and second lower track members 52 and 54 are curved inwardly relative to each other to cooperatively form a convex shape 60 having a slot 62 formed therebetween. A locking element 64 diagonally disposed within cavity 66 extends substantially the length of the first lower track member 52 to selectively engage a panel gripping means generally indicated as 68.

The panel gripping means 68 comprises a substantially vertically disposed base member 70 having a substantially horizontally disposed handle 72 extending outwardly from the mid-portion thereof and arcuate locking element 74 formed on the lower portion thereof. A panel securing means comprising a substantially flat member 76 is fromed on the mid-portion of the base member 70 to sandwich the flexible panel member 14 therebetween to attach the panel gripping means 68 to the lower edge thereto. A stop 78 extends outwardly from the base member 70 to engage the shield 28 when the flexible panel member 14 is in the retracted position.

Figure 5:
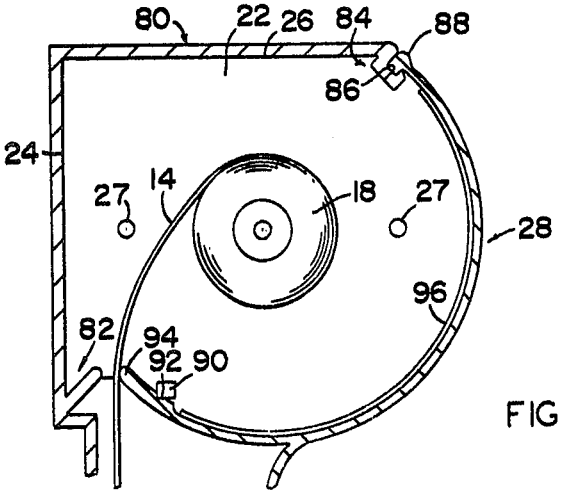
FIG. 5 is a cross-sectional detail side view of the end plate, header and shield combination.

As shown in FIG. 5, the convex shield means 28 is specifically configured to engage the upper portion of the flexible panel member 14 to form a seal therebetween. A header generally indicated as 80 which is secured to the structure frame extends between the end plates 20 and 22. The end plates 20/22 and header 80 are correspondingly configured at 82 and 84 to press-fit together to form a unitary construction. A channel 86 is formed on the header 80 to receive tongue or ledge 88 formed on the upper portion of the shield 28 while a lug 90 extends outwardly from the interior sides of the end plates 20/22 to receive a notch 92 formed on the lower portion of the shield of 28. Thus the shield means 28 and header 80 cooperatively form a housing to at least partially enclose the roller means 18.

An arcuate sealing surface 94 extends longitudinally along the lower edge of the shield 28 to engage the inner surface flexible panel member 14 as the flexible panel member 14 is extended. A peripheral ridge 96 is formed on the interior of the end plates 20/22 to form a sealing surface with the shield 28. Alternately when used with a door (not shown) the header 80 may be disposed on the opposite or outside of the roller means 18 such that the header 90 forms the housing including the sealing surface.

In operation downward extension of the flexible panel member 14 causes the side or longitudinal peripheral edges thereof to travel on the interior of the respective side track means 32, as best shown in FIG. 3. When the panel reaches its downward most extension the lower most peripheral edge is disposed on the interior of the lower track means 50 such that locking elements 64 and 74 engage each other to effectively seal or isolate air space as previously disclosed.

It will thus be seen that the objects set forth above, among those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An insulation assembly comprising a retractable flexible panel means mounted on a roller element affixed within a conventional portal frame structure including a closure such as a window or door, said retractable flexible panel means including a flexible panel member having a panel gripping means affixed to the lower portion thereof and a side track means disposed on opposite sides of said flexible panel member, each said side track-means comprising a first and second side track member disposed in substantially parallel spaced relationship relative to each other and to said flexible panel member, the outer portion of said first and second side member being curved inwardly toward each other to cooperatively form an arcuate shape having a slot formed therebetween to form a cavity to receive respective opposite ends of said flexible panel member, said first and second track members each including a sealing element within said cavity inclined inwardly away from said slot, each said sealing element extending beyond the centerline between said first and said second track members to engage opposite surfaces of said flexible panel member disposed within said cavity such that said flexible panel member forms a curvilinear configuration within said cavity to substantially seal respective opposite sides of said flexible panel member.

2. The insulation assembly of claim 1 further including a lower track means to seal the lower portion of said flexible panel member when said flexible panel member is in the fully extended position, said lower track means comprising a first and second lower track member disposed in substantially parallel spaced relation relative to each other and to said flexible panel member, the outer portion of each said first and second lower track member being curved inwardly relative toward each other to cooperatively form an arcuate shape having a slot formed therebetween to form a cavity to receive said panel gripping means when said flexible panel member is in the fully extended position, said first lower track member including a diagonally disposed locking element extending into said cavity such that said panel gripping means engages said diagonally disposed locking element and said second lower track member to seal the lower portion of said insulation assembly when said flexible panel member is in the fully extended position.

3. The insulation assembly of claim 1 wherein said panel gripping means comprises a substantially vertically disposed base member having a substantially horizontally disposed handle extending outwardly from the mid-portion thereof.

4. The insulation assembly of claim 3 wherein said panel gripping means further includes a panel securing means comprising a substantially flat member formed on the mid-portion of said base member to cooperatively receive the lower portion of said flexible panel member therebetween.

5. The insulation assembly of claim 3 wherein said panel gripping means further includes a stop formed on the upper portion of said base member to engage said shield when said flexible panel means is in the retracted position.

6. The insulation assembly of claim 1 further including a shield disposed in surrounding relationship relative to the roller element, said shield including an arcuate surface formed on the lower portion thereof to engage said flexible panel member to form a seal therebetween.

* * * * *